United States Patent [19]

Racicot

[11] Patent Number: 4,615,130

[45] Date of Patent: Oct. 7, 1986

[54] SNOWPLOW MOUNTED ON LONGITUDINAL FRAME ATTACHABLE TO CHASSIS

[76] Inventor: Gerald Racicot, 5521 rue St-Joseph, Valcourt, Quebec, Canada, JOE 2LO

[21] Appl. No.: 738,367

[22] Filed: May 28, 1985

[51] Int. Cl.[4] ..... E01H 5/04

[52] U.S. Cl. ..... 37/231; 37/283; 172/272

[58] Field of Search ..... 37/231, 232, 233, 241, 37/266, 270, 271, 279, 283; 172/272, 273, 274, 810, 817, 245, 246, 248

[56] References Cited

U.S. PATENT DOCUMENTS

| | | | |
|---|---|---|---|
| 2,700,233 | 1/1955 | Johnson et al. | 37/232 X |
| 2,776,767 | 1/1957 | Stover | 37/231 |
| 2,863,315 | 12/1958 | Blanchet | 37/232 |
| 3,422,553 | 1/1969 | Holloway | 37/232 X |
| 3,669,194 | 6/1972 | Zurek | 37/231 X |
| 3,688,847 | 9/1972 | Deeter | 37/231 X |
| 3,793,752 | 2/1974 | Snyder | 37/233 |
| 4,255,878 | 3/1981 | Mahler et al. | 37/232 |
| 4,259,794 | 4/1981 | Rath | 37/232 |
| 4,307,523 | 12/1981 | Reissinger et al. | 37/232 |
| 4,470,211 | 9/1984 | Rossman | 37/231 |

FOREIGN PATENT DOCUMENTS

| | | | |
|---|---|---|---|
| 264572 | 12/1967 | Austria | 37/232 |
| 2617235 | 10/1977 | Fed. Rep. of Germany | 37/232 |
| 3205973 | 9/1983 | Fed. Rep. of Germany | 37/232 |
| 3205974 | 9/1983 | Fed. Rep. of Germany | 37/232 |
| 771260 | 10/1980 | U.S.S.R. | 37/232 |

*Primary Examiner*—E. H. Eickholt

*Attorney, Agent, or Firm*—Larson & Taylor

[57] ABSTRACT

The present invention relates to a snowplow blade to be attached to a small all terrain vehicle. The snowplow blade comprises a lower portion constituted by a rubber sheet, the bottom edge of which is urged forwardly by a ground-engaging bar biased forwardly by springs. The rubber sheet and the ground engaging bars are free to yield rearwardly against the springs, when sufficient resistance is encountered. The invention also pertains to an attachment for connecting the snowplow blade to a vehicle. The attachment is constituted by a frame having a main point of connection with the vehicle at the rear end thereof, the front end of the frame being suspended from the chassis of the vehicle. Also described is a removable scraping edge mounted to the lower edge of the rubber sheet.

18 Claims, 8 Drawing Figures

SNOWPLOW MOUNTED ON LONGITUDINAL FRAME ATTACHABLE TO CHASSIS

FIELD OF THE INVENTION

The present invention relates to a device for clearing away snow or loose granular material such as sand, earth, crushed stones and the like. More particularly the invention pertains to a shock-absorbing snowplow blade, which will absorb the shocks resulting from obstacles on the ground. The snowplow blade of this invention can be mounted to relatively small vehicles normally not used for clearing snow, e.g. three-wheel motorcycles.

The invention also relates to an attachment for connecting the snowplow blade or another implement to a small vehicle, the attachment transmitting the efforts arising during the operations of the snowplow blade to the rear end of the vehicle.

BACKGROUND OF THE INVENTION

In northern countries where the climate during the winter is harsh, removal of the snow from roads and highways is of great concern. Large organizations such as municipalities of governments are equipped to handle this job with heavy machinery specifically designed for snow clearing purposes. These machines are very efficient but are expensive and bulky. For individuals who have to clean a relatively small area, such as passageways or private driveways this heavy equipment is ill adapted.

Hitherto, small all terrain vehicles such as three-wheel motorcycles of the type sold under the trade mark Honda ATC, or four-wheel vehicles of a similar size, were not used for clearing snow because they are not designed for such use. In particular, their frame and driving train are not strong enough to withstand the force of the impacts encountered when using snowplows of conventional design. During the operation of a conventional snowplow, the blade often hits obstacles such as stones, blocks of ice or objects protruding from the ground which are hidden by the snow and therefore invisible to the driver. Such obstacles impose severe stresses to the snowplow blade which are transmitted to the chassis of the vehicle pushing it. With the small all terrain vehicles of the type contemplated, such stresses would soon damage the vehicle and necessitate costly repairs.

During the operation of a snowplow utilizing a conventional rigid blade, the later rests on the ground while the vehicle pushes it forwardly. The bottom edge of the blade acts as a scraper and not only removes the fresh snow off the ground but also scrapes the ground surface. When a conventional snowplow is operated on a sloping or an uneven terrain, its rigid bottom edge tends to dig into the ground thus hitting the ground's irregularities which has the effect of considerably slowing down the vehicle, and, in most cases, damaging the surface of the ground and the edges of the adjacent lawns or gardens.

Generally speaking, a conventional rigid snowplow blade has the tendency to level the terrain which is cleaned by flattening the irregularities. In the majority of the cases this does not present any major problems since the vehicles used with these prior art blades are sufficiently strong and powerful to achieve such a levelling action. However, if a small all terrain vehicle is to be used with a conventional blade, it will not be able to operate in a satisfactory manner since it is not powerful enough and it does not offer a good traction because of its reduced weight, in order to achieve a levelling action.

Another problem which renders difficult the adaptation of these small vehicles for snow removing purposes resides in the fact that the snowplow blade has to be attached to the front end of the vehicle, and therefore the front suspension has to carry the weight of the snowplow blade, which may be substantial, and further has to take the pressure and the load exerted against the vehicle during the snow removal operation. These loads may damage the front suspension.

OBJECTS AND STATEMENTS OF THE INVENTION

It is an object of the present invention to provide a snowplow blade which absorbs impacts and which protects the chassis of the driving vehicle and its drive train from damages resulting from snow removal operations.

Another object of this invention is to provide an attachment for a snowplow blade or similar implement to the front of a vehicle, which attachment will transmit the stresses to a point remote from the front suspension of the vehicle.

Another object of this invention is to provide a snowplow blade well adapted to cope with ground irregularities and which will not dig into the ground nor damage adjacent terrains.

Another object of this invention is to provide a snowplow blade which will provide a selective snow removing action in that it will carry away the fresh or the soft snow while leaving the major portion of the ice crust on the ground's surface thus protecting the surface of the ground being cleared.

Still, another object of this invention is to provide a snow removing unit which is to be attached to a small all terrain vehicle for converting the latter for snow clearing purposes and at the same time protecting the chassis and the front suspension of the vehicle from impacts with obstacles and from excessive stresses.

The above-mentioned objects are achieved by providing in accordance with this invention, a snowplow blade having a rearwardly yieldable lower portion for engaging the ground. The snowplow blade according to the invention has a generally concave shape and it performs the snow removing function the same way as the prior art devices, that is, scraping the snow off the ground with its bottom edge, the concave shape of the blade causing the snow to be deflected forwardly and/or laterally depending on the position of the blade relative to the vehicle.

The lower portion of the snowplow blade, which may be the lower half for example, is constituted by a thick rubber skirt of sheet which is attached to the upper, rigid portion, the deflector body. The latter is of a conventional construction, that is to say rigid and concave shaped and it constitutes the snow deflecting body receiving the snow from the scraping portion and ejecting same away.

A ground-engaging bar is mounted behind the bottom edge of the rubber sheet and extends therealong. The ground-engaging bar rigidifies the bottom edge of the rubber sheet and allows it to perform the scraping function.

The ground-engaging bar is pivotally mounted to the deflector body and it can yield rearwardly if sufficient resistance is encountered. This is achieved by biasing the bar forwardly with coil springs.

When the snowplow blade meets an obstacle, the rubber sheet and the ground-engaging bar yield rearwardly to substantially or completely absorb the shock which otherwise might damage the chassis of the driving vehicle. Under normal operating conditions, the coil springs are sufficiently rigid to hold the bar in operative position against the pressure exerted by the snow. The rubber sheet must be of a sufficient thickness to provide the necessary stiffness and thus prevent the pressure of the snow from unduly distorting or bending the skirt.

Since the ground engaging bar is free to yield rearwardly and because of the flexibility of the rubber skirt, the snowplow blade adapts itself to ground irregularities which may be encountered during the snow cleaning operation. For example if a small bump is encountered, the pressure on the ground-engaging bar will deflect rearwardly and the blade will pass over the bump and without slowing down the vehicle.

Similarly, when an area carrying a layer of hard ice is cleaned, the ground-engaging bar will ride on the ice layer removing only the loose snow thereon. Likewise, when running over a soft surface such as a lawn, the surface of the ground is not damaged by the snowplow.

The attachment which connects the snowplow blade to a vehicle is constituted by a frame which is mounted under the chassis of the driving vehicle and has a main connection point with the latter at the rear end of the vehicle. The front end of the frame projects forwardly from the front of the vehicle and receives the snowplow blade. The front portion of the frame is suspended from the front of the vehicle with some degree of lateral constraint.

The vehicles of the type described earlier have a rear end which is substantially stronger than the front end, since it is designed for pulling loads such as in drawing a trailer or a similar equipment. By providing the attachment of the invention, substantially all the stresses, occurring during the snow removal process, are transmitted to the rear end of the vehicle via the load pulling hitch of the driving vehicle. Therefore, the vehicle is subjected to efforts which it has been designed to withstand, and there are no excessive stresses upon the front, relatively fragile suspension and steering mechanism.

Therefore, the present invention comprises in its most general aspects a shock-absorbing snowplow blade for a relatively small vehicle, the snowplow blade comprising a transversally extending rigid snow deflecting body which is positioned generally vertically and has an upper edge projecting forwardly. The deflecting body is adapted to receive and deflect the snow in a generally frontal direction.

The snowplow blade further comprises a ground-engaging bar which extends parallel to and is located below the snow deflecting body leaving an open space therebetween. The ground-engaging bar has approximately the length of snow deflecting body and has a substantially vertical flat frontal surface.

A rearwardly swinging arm means has an end attached to the ground-engaging bar and an opposite end pivoted to the snow deflecting body in a region thereof which is remote from the lower front edge thereof. The rearwardly swinging arm means is biased forwardly against stop means by return spring means causing the ground-engaging bar to yield rearwardly when the snowplow blade encounters an obstacle during the operation thereof. The rearwardly swinging arm means and the ground-engaging bar form a support which holds the snow deflecting body at a predetermined height above the ground.

A flexible deflector in the form of a thick strip of rubber or the like material is attached to the snow deflecting body along the lower front edge thereof, the flexible deflector having approximately the length of the snow deflecting body and extending downwardly to the ground in front of the ground-engaging bar. The bottom edge of the flexible deflector rests against and is urged forwardly by the flat frontal surface during operation of the snowplow blade. The latter further comprises means mounted to the snow deflecting body for attaching the snowplow blade to a vehicle.

The attachment for connecting the snowplow blade may be most generally described as an implement attachment for attaching an implement to an all terrain vehicle such as three-wheel or four-wheel motorcycle, the vehicle being of the type having a rear-end adapted to sustain pulling loads such as in drawing a trailer or similar equipment. The implement is adapted to be positioned in front of the vehicle.

The attachment comprises an elongated frame adapted to be mounted under the chassis of the vehicle and extending longitudinally therealong, the frame being attached to the vehicle at the rear end thereof and at an additional location thereof in front of said rear end, the attachment being made by releasable connecting means. Such an arrangement transfers to the rear of the driving vehicle the snowplow stresses, thus converting the efforts into a pulling load for the hitch of the driving vehicle.

The frame further comprises an implement carrying arm means pivoted at one end to the front portion of the frame in order to swing in a vertical longitudinal plane, for raising or lowering said implement, the implement carrying arms means comprising at the other end attachment means for holding the implement. The frame is also provided with actuation means for raising or lowering the implement carrying arms means.

The snowplow blade and the frame for attaching the snowplow blade to a vehicle, form a snow removal unit for a small all terrain vehicles.

The expression "snowplow blade" as used herein is not to be considered as limited to a blade for snow clearing purposes only. Although created mainly for such use, the device may also be advantageously used for removing any other loose granular material such as sand, earth, crushed stones and the like.

BRIEF DESCRIPTION OF THE DRAWINGS

A detailed description of a preferred form of the invention will now be given with reference to the following drawings in which.

DESCRIPTION OF THE PREFERRED EMBODIMENTS

Figure 1:
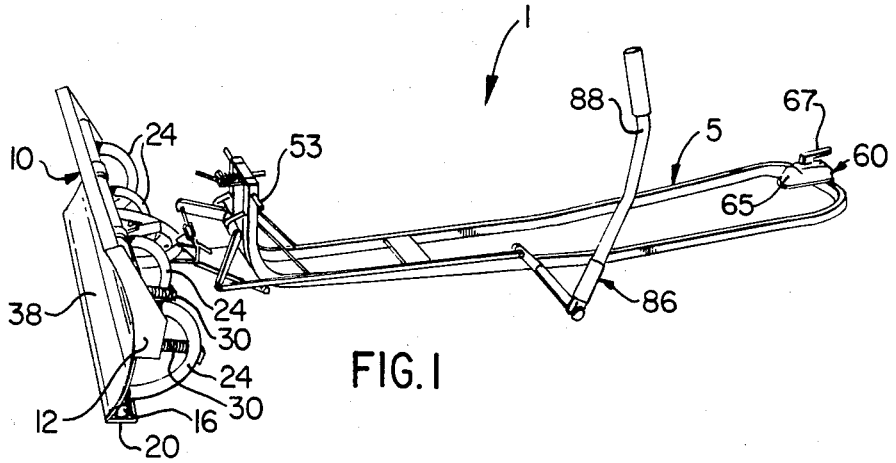
FIG. 1 is a perspective view of a snow removal unit according to the present invention.
Figure 2:
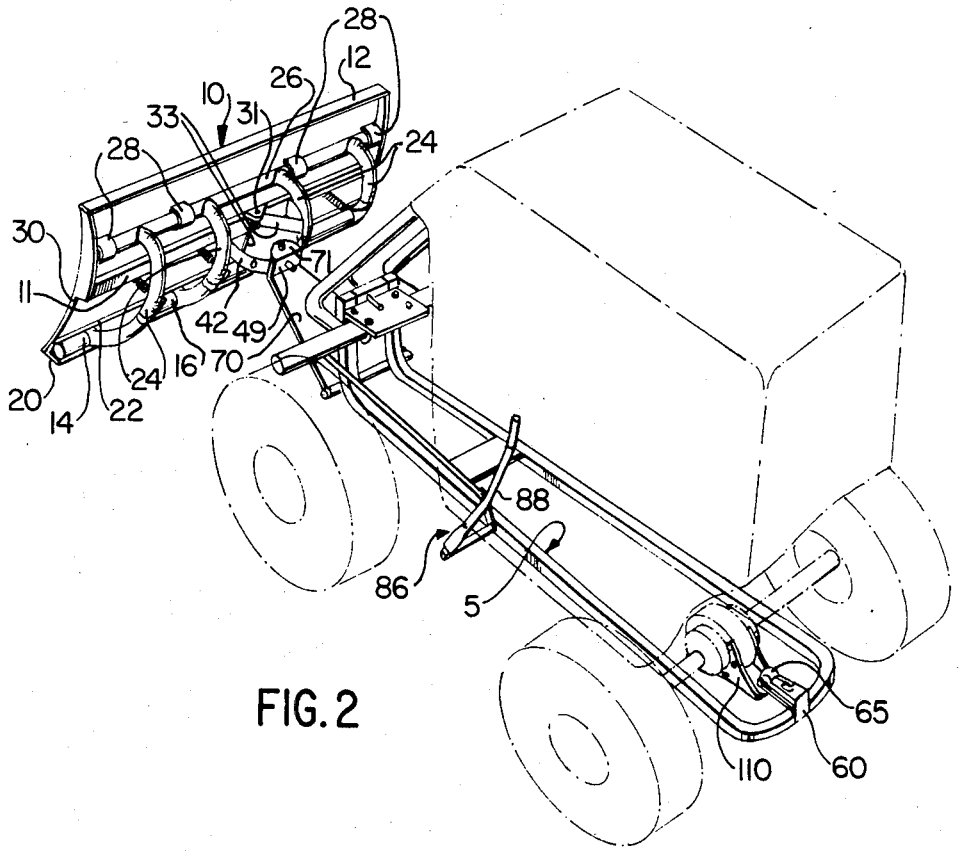
FIG. 2 is a perspective view illustrating the frame and the snowplow blade mounted to a four-wheel motorcycle.

Referring now to FIGS. 1 and 2 illustrating a snow removal unit, generally designated by the reference numeral 1 and designed to be attached to a vehicle such as the one shown in FIG. 2 in phantom lines, comprises a snowplow blade 10 secured to a snowplow blade attachment 5 for connecting the snowplow blade 10 to a driving vehicle.

The snowplow blade 10 comprises a transversally extending rigid snow deflecting body 12 which has a substantially concave shape. Body 12 constitutes the upper half of blade 10 and may be made preferably of steel or of any other material which provides the necessary rigidity. On the back of body 12, channel 11 extends along the full length of body 12. to import further rigidity.

Figure 4:
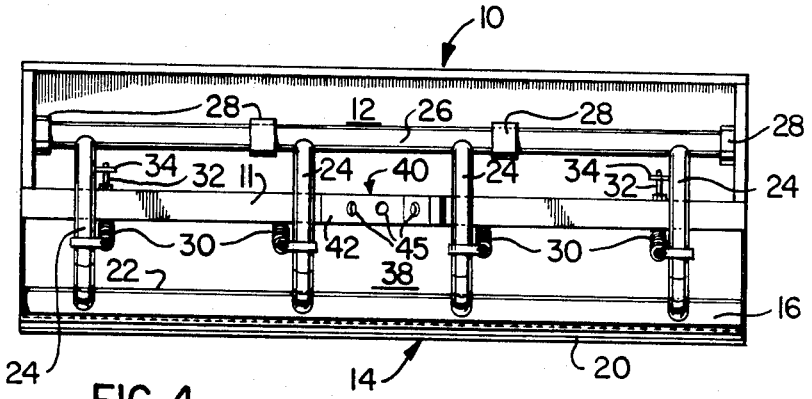
FIG. 4 is a rear elevational view of the snowplow blade of FIGS. 1 and 2.
Figure 5:
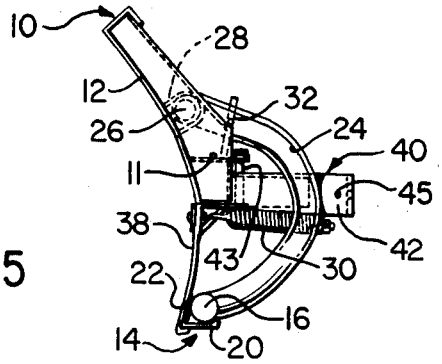
FIG. 5 is a side view of the snowplow blade of FIG. 4.

As best shown in FIGS. 4 and 5, a ground-engaging bar 14 extends parallel to and below the snow deflecting body 12. The ground-engaging bar 14 has approximately the length of body 12 and may be made of a steel tube 16 nested between the flanges of an angle iron 21 comprising a horizontal flange 20 adapted to slide on the ground and a substantially vertical flange 22 behind flexible skirt 38 as will be described below.

The ground-engaging bar 14 is connected to the snow deflecting body 12 by four arms 24, each bent in the form of a semi-circle in a plane perpendicular to body 12. Arms 24 have a lower end welded or otherwise secured to tube 16. Arms 24 are preferably fabricated from steel tubing.

The upper end of arms 24 is welded to a horizontal pivot rod 26, which is also made of steel tubing, pivoted to the back of deflecting body 12. More specifically, rod 26 is attached to body 12 by four spaced apart bushings 28 welded to body 12.

Two horizontal lugs 34 attached to the outer arms 24 receive an adjustment screw 32 threadedly engaged therein. The heads of screws 32 rest against channel 11 to limit the downward and forward position of ground-engaging bar 14. Arms 24 and ground-engaging bar 14 are urged forwardly by four coil springs 30, each having a forward end attached to snow deflecting body 12 and a rearward end attached to a corresponding arm 24. By raising or lowering screws 32 in lugs 34, the forwardmost position of bar 14 may be adjusted as desired.

A flexible deflector 38, made of thick rubber like material is connected along the lower edge of body 12, and has substantially the same length thereof. The flexible deflector 38 extends downwardly to the ground in front of the ground-engaging bar 14 and its bottom edge freely rests against vertical flange 22 of angle iron 21.

If desired a removeable scraper blade 29 may be attached to the bottom edge of the flexible deflector 38 by means of bolts (not shown) for facilitating the removal of ice or heavier snow which would otherwise escape under the snowplow.

Snowplow blade 10 also comprises a coupling 40 for connecting blade 10 to the snowplow blade attachment 5. As shown in FIGS. 2, 4 and 5, coupling 40 comprises a semi-circular bracket 42 attached at both ends thereof to channel 11. Bracket 42 is provided at the center thereof with a pivot 31 constituted by a vertically extending bolt 43, in a lug welded to deflecting body 12 and two reinforcing arms 33 projecting inwardly from bracket 42. Bracket 42 further comprises 3 spaced apart holes 45 for receiving a lock pin as will be described below.

The operation of snowplow blade is as follows.

The snowplow blade 10 is pushed forwardly by the driving vehicle and the flange 20 of the ground-engaging bar 14 slides on the surface of the ground. Ground-engaging bar 14 and arms 24 hold the snow deflecting body 12 at a predetermined height above the ground. Flexible deflector 38 scrapes the snow from the ground and transfers it to the rigid snow deflecting body 12 which in turn ejects the snow in a generally frontal direction. The bottom edge of the flexible deflector 38 rests against vertical flange 22 and is urged forwardly by the latter. It should be noted that flange 22 must be of sufficient height for providing a suitable support for deflector 38 in order to prevent the latter from collapsing rearwardly over the ground-engaging bar during operation.

When snowplow blade 10 encounters an obstacle, flexible deflector 38 and arms 24 yield rearwardly. Coil springs 30 absorb the shock and, only a small portion of the impact is transmitted to the driving vehicle, thus preventing damage thereto.

Once beyond the obstacle, springs 30 return the ground-engaging bar 14 in its forwardmost position.

Referring now to FIGS. 1, 2, 3, 6 and 7, illustrating attachment 5 for connecting the snowplow, attachment 5 has a frame 50 comprising two substantially parallel struts 52 and 54, made preferably of steel tubing of square cross-section. The front portion of struts 52 and 54 project upwardly.

Struts 52 and 54 are interconnected by a cross plate 56 and also comprise two strengthening braces 57 and 59 respectively, mounted between the vertically extending portion of the struts and the portion of the struts immediately behind.

Figure 3:
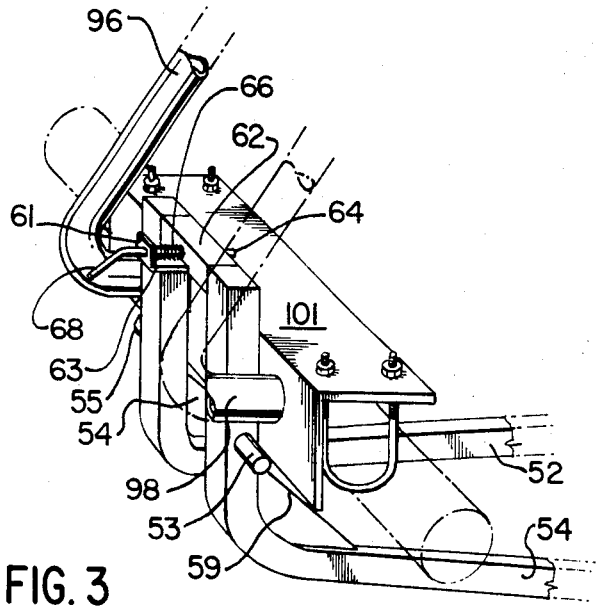
FIG. 3 is an enlarged perspective view of the front portion of the attachment suspended from the vehicle as illustrated in FIG. 2, some elements being omitted for clarity.
Figure 6:
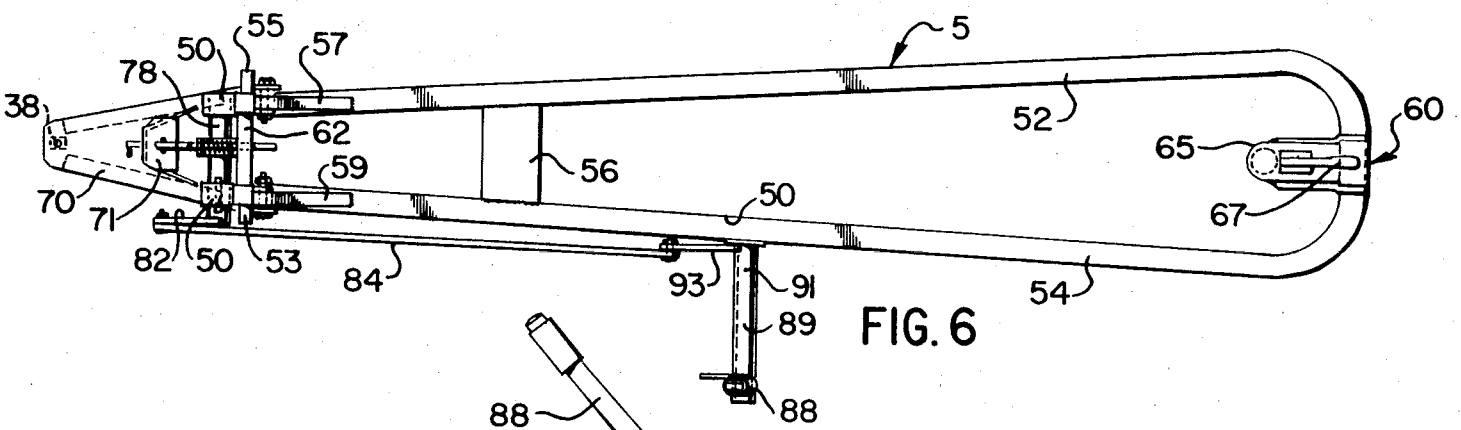
FIG. 6 is a plan view of the snowplow attachment illustrated in FIGS. 1 and 2.
Figure 7:
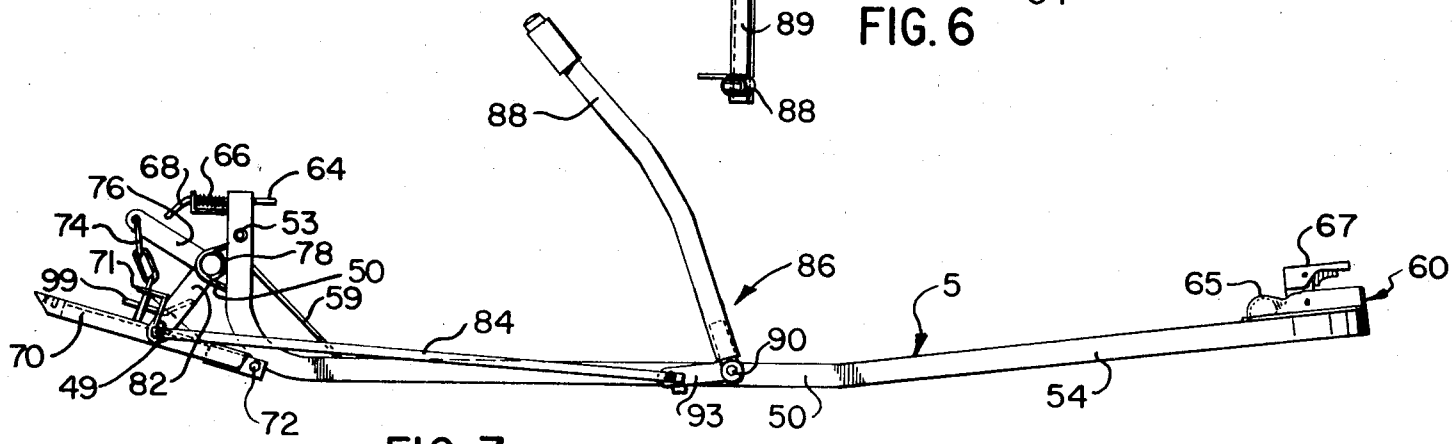
FIG. 7 is a side view of the snowplow attachment illustrated in FIG. 6.

The upper ends of struts 52 and 54 carry laterally projecting pins 53 and 55, respectively. The function of these pins as will be explained below, is to limit the upward movement of attachment. A cross member 62 extends between struts 52 and 54 at the upper ends 152 thereof. Member 62 carries an L-shaped plate 63 (see FIG. 3) and a horizontally extending retractable pin 64 which is spring biased and slidably mounted to apertured L-shaped plate 63 and which protrudes through cross member 62. Bent portion 68 of retractable pin 64 serves as a handle. Return spring 66, mounted between L-shaped plate 63 and member 62, biases retractable pin 64 in an extended position wherein the rear end of retractable pin 64 projects rearwardly beyond cross member 62 as shown in FIGS. 3, 6 and 7.

The rear end of frame 50 is a U-shape extension 150 to which is mounted a hitch 60 which is constituted by a femalepart secured to extension 150 comprising a cup shaped socket 65 adapted to receive a malepart constituted by a ball (not shown) attached at the rear end of the vehicle to a bracket 110 (see FIG. 2). Socket 65 comprises a locking lever 67 which is used to lock the hitch 60 and prevent the removal of socket 65 from the driving vehicle. When locked, socket 65 is free to rotate on the ball of bracket 110.

This type of hitch is very well known and it is used mainly for attaching a trailer to a vehicle. A detailed description and the elements constituting the hitch is not deemed to be necessary since it is well known in the trailer art.

Frame 50 also comprises an implement carrying arm 70 which is triangularly shaped and has a free end portion 170 and an inner end pivoted at 72 to the front end of frame 50 below the upwardly curved ends 152 thereof. Carrying arm 70 is provided centrally thereof with an upstanding flange 49 having an upper portion 71 projecting forwardly. Flange 49 carries a horizontally extending retractable pin 39. The free end 170 of carrying arm 50 is pointed and is provided with an aperture 38 adapted to receive therein pivot pin 43 of snowplow 10. Simultaneously, retractable pin 39 is fitted in one of holes 45 of bracket 40 for setting the angle of snowplow 10 relative to the longitudinal axis of attachment 5. In FIGS. 1 and 2, snowplow 10 is perpendicular to attachment 5 because pin 39 is slipped into central aperture 45. Using a different hole 45 would set snowplow 10 sideways.

A horizontally extending pivot rod 78 is rotatably mounted across upstanding portion 152 of struts 52 and 54 by two bushings 155. Rod 78 carries two levers 76 and 82 radially projecting therefrom and extending at an angle to each other, generally at right angle. Lever 82 is mounted at one end of rod 78 and lever 76 is mounted centrally of rod 78. A chain 74 connects lever 76 to the forwardly projecting upper portion 71 of flange 49 for lifting same and the snowplow 10 it carries.

Frame 50 also comprises a handle assembly 86 having a handle 88 fixed at its lower end 90 to an end of pivot rod 89 which is pivoted to strut 54. Pivot rod 89 also supports at its inner end 91 a lever 93 to which is pivoted a connecting rod 84 in turn pivoted to the free end of lever 82. A stopper 180 secured to strut 54 slightly below the imaginary line between pivot rod 89 and the pivot point 184 of connecting rod 84 and lever 82 affords a knee action when handle 88 is pushed fully forwardly to maintain snowplow carrying arm 70 in the raised position as in FIG. 7. Release of handle 88 when pulled rearwardly from the position shown in FIG. 7 to that shown in FIGS. 1 and 2 causes rearward motion of connecting rod 84, lowering of lever 82, pivoting of rod 78, lowering of lever 76, of chain 74 and of arm 70.

The method of attaching frame 50 to the vehicle and the method for connecting snowplow blade 10 to carrying arm 70 will now be explained.

Frame 50 is first inserted under the chassis of the vehicle with snowplow 10 already in place on carrying arm 70. Socket 65 of hitch 60 is mounted on the ball attached to the rear bracket 110 of the vehicle. Then hitch 60 is locked by lowering locking lever 67.

At this point, the rear end portion of attachment 5 is adequately coupled to the driving vehicle but the front end portion and the snowplow 10 thereon rest freely on the ground. As best seen in FIGS. 2 and 3, the driving vehicle in the case of a four-wheel motorcycle, must be equipped with a front bumper to support the front end portion of attachment 5. In the illustrated example, the driving vehicle comprises a bumper 201 to which is affixed an angle iron bracket 101 by U-bolts 204 for supporting a roll-bar arrangement 206, 208 covered by a soft top 210 for the protection of the rider (not shown).

The vertically extending portion 152 of struts 52 and 54 is inserted between roll-bars 206, 208 while retractable pin 64 is pulled forwardly. Pins 53 and 55 rest below the downwardly and inwardly extending lower portions 210 of roll-bars 206 and 208. When the front of frame 50 has been fully raised, handle portion 68 is released and spring 66 returns retractable pin 64 to its extended position overlying the horizontal flange of angle iron bracket 101. Therefore, the front end of frame 50 of attachment 5 is suspended from the front of the driving vehicle. This completes mounting of the snowplow assembly to the driving vehicle, an operation taking a mere few seconds.

It should be observed that the struts 52 and 54 do not fit tightly between roll-bars 206 and 208, there being sufficient play to allow a certain degree of lateral motion between the frame 50 and the chassis of the driving vehicle.

A verical play is also allowed. Over pins 53 and 55 relative to roll-bars 206 and 208 at 210. When retractable pin 64 rests upon the horizontal flange of bracket 101, the distance between pins 53 and 55 and the portion 210 of the roll-bars 206 and 208 is of the order of $\frac{3}{4}$ to $\frac{1}{4}$ of an inch, which allows a certain degreee of rocking motion of the snowplow assembly. This amount of free play is necessary in order to accommodate the movements of the snowplow blade when it rides on an uneven surface.

For attaching the snowplow blade 10 to the carrying arm 70 before mounting same to the driving vehicle, free end 170 of arm 70 is inserted under bracket 42 and the bolt 43 is inserted in aperture 38 of free end 170. Therefore, the snowplow blade 10 is free to turn around bolt 43. Holes 45 correspond each to a different angular position of blade 10 relatively to the vehicle. If one wishes to install the blade 10 in a given position, the hole 45 corresponding to such position much align with flange 49. Retractable 39 is then inserted through the selected hole 45, locking the snowplow in such position.

Handle 88 extends outside of the cab 210 of the driving vehicle and is mounted at such a distance that it may be easily reached by the driver. The length of handle 88 and of levers 93, 82 and 76 determine the effort to be exerted when pushing handle 88 forwardly in order to raise or lower the carrying arm 70 and the snowplow blade 10.

As best shown in FIGS. 6 and 7, struts 52 and 54 are bent at 256. Although not essential to the invention, it is believed that such bending of the struts will protect the structure of the driving vehicle in the event of unforeseen impacts by allowing a certain degree of resilient bending of frame 50 at bends 256.

Figure 8:
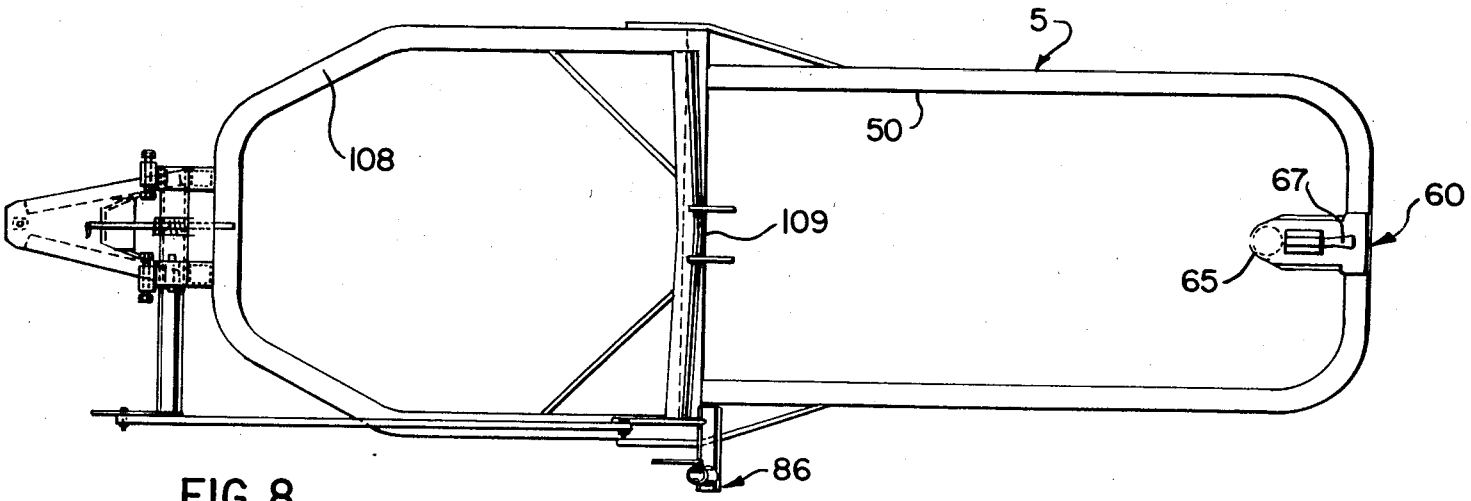
FIG. 8 is a plan view of a modified embodiment of the snowplow attachment for use with a three-wheel motorcycle.

FIG. 8 illustrates another embodiment of frame 500 of attachment 595 to be used with a three-wheel motorcycle the front wheel of which is to be received in an encircling portion 298 of frame 500. Frame 500 is attached to the three-wheel motorcycle at the rear end thereof by a hitch 60, identical to that described earlier and is also attached by bracket 300, to the structure of the motorcycle between the front wheel and the engine of the motorcycle.

Frame 500 comprises longitudinal struts 552 and 554 joined at the rear by a U-shaped extension 550 where hitch 60 is secured. Struts 552 and 554 are welded to a cross-member 560 of loop 298 and braces 562 and 564 strengthen this planar assembly. Bracket 300 is of particular design for each make of three-wheel motorcycle. In this illustrated example, bracket 300 is a pair of rearwardly extending lugs secured to a slightly bent angle iron 310 welded to loop 298 over cross-member 560. At the front end of loop 298, bushings 555 are provided to receive pivot rod 578 which is lightly longer than pivot rod 78 of FIG. 6 but serves the same purpose. Pivot pin 578 carries an upwardly extending lever 82 to which is attached a connecting rod 84 pivoted to actuating lever 93 of handle 86 corresponding to similar elements described above in association with FIG. 6.

Bushings 555 are secured to loop 298 via posts 572 and 574 which also mount pivots 582 (not shown) and 584 (not shown) below bushings 555. Pivots 582 and 584 support the inner end of the implement carrying arm 70.

For mounting to a three-wheel motorcycle, the attachment 595 with a snowplow thereon such as snowplow 10 of FIGS 1, 2, 4 and 5, the snowplow is first connected to attachment 595. Then, coming from the rear of attachment 595, the motorcycle is slowly driven over the frame 500 with its front wheel within loop 298 and its rear wheels on either sides of struts 552 and 554. Hitch 60 is then coupled with the trailing hitch ball of the motorcycle and locking lever 67 is lowered to lock the connection at that point. Thereafter a cross-pin (not shown) or a bolt is sliped through the lugs of bracket 300 when same register with a corresponding bracket on motorcycle's engine mount as the front end of frame 500 is raised above the ground. For removing, the reverse procedure is followed, as in the case of the four-wheel motorcycle described above.

Although this invention has been described with reference to specific embodiments, it is obvious that various modifications may be made by a person skilled in the art. Therefore, it is wished to have it understood that this description should not be considered limiting in any way, except by the terms of the following claims.

The embodiments of the invention in which an exclusive property or privilege is claimed are defined as follows:

1. A shock-absorbing snowplow blade for a relatively small vehicle comprising:

a transversely extending rigid snow deflecting body positioned generally vertically and having an upper edge projecting forwardly, said snow deflecting body being adapted to receive and deflect the snow in a generally frontal direction;

a ground-engaging bar extending parallel to and located below said snow deflecting body leaving an open space therebetween, said ground engaging bar having approximately the length of said snow deflecting body and having a substantially vertical flat frontal surface;

rearwardly swinging arm means having an end pivoted to said body in a region thereof which is remote from the lower front edge thereof, said rearwardly swinging arm means having an opposite end attached to said ground-engaging bar, said rearwardly swinging arm means being biased forwardly against stop means by return spring means to cause said ground-engaging bar to yield rearwardly when the snowplow blade encounters an obstacle during the operation thereof, said rearwardly swinging arm means and said ground-engaging bar forming a support holding said snow deflecting body a predetermined height above the ground;

a flexible deflector in the form of a thick strip of rubber or the like material attached to said snow deflecting body along the lower front edge thereof, said flexible deflector having approximately the length of said snow deflecting body and extending downwardly to the ground in front of the ground-engaging bar, the botton edge of said flexible deflector resting against and being urged forwardly by said flat frontal surface during operation of said snowplow blade; and means mounted to said snow deflecting body for attaching said snowplow blade to a vehicle.

2. A shock absorbing snowplow blade as defined in claim 1, wherein said rearwardly swinging arm means have an end pivoted to the upper portion of said snow deflecting body.

3. A shock absorbing snowplow blade as defined in claim 1, wherein said ground-engaging bar comprises an angle iron comprising a substantially vertical flange integral with a horizontal flange which rests on the ground, said angle iron further comprising a tubular reinforcement member nested between said flanges.

4. A shock-absorbing snowplow blade as defined in claim 1, wherein said rearwardly swinging arm means is constituted by a plurality of arms having each an end pivoted to the upper portion of said body and an opposite end attached to said ground-engaging bar.

5. A shock-absorbing snowplow blade as defined in claim 4, wherein each of said arms is bent in the form of a semi-circle in a plane perpendicular to said body.

6. A shock-absorbing snowplow blade as defined in claim 4, wherein a coil spring is mounted between each said arms and said snow deflecting body, the coil springs constituting said return spring means.

7. A shock-absorbing snowplow as defined in claim 6, comprising four evenly spaced apart rearwardly swinging arms.

8. A shock-absorbing snowplow as defined in claim 1, wherein said flexible deflector is made of rubber.

9. A shock-absorbing snowplow blade as defined in claim 1, and further comprising elongated scraper blade attached to said flexible deflector along the bottom edge thereof, said scraper blade having a length corresponding to the length of said flexible deflector and extending adjacent to the ground.

10. A shock-absorbing snowplow blade for a three wheel motorcycle, comprising:

a horizontal transversely extending, rigid snow deflecting body having a concave shape and being adapted to receive and deflect the snow in a generally frontal direction;

a ground-engaging bar having approximately the length of said snow deflecting body and being mounted parallel to and below said snow deflecting body and leaving an open space therebetween, said ground-engaging bar comprising an angle iron constituted by a substantially vertical flange integral with a horizontal flange contacting the ground, said ground-engaging bar further comprising a reinforcement member nested between said flanges;

a plurality of rearwardly swinging arcuate arms each having an end attached to a horizontally extending rod pivoted to said body in the upper portion thereof and an opposite end attached to said reinforcement member, each of said arcuate arms being biased forwardly against stop means by a coil spring mounted between said arm and said snow deflecting body in such a way as to cause said ground-engaging bar to yield rearwardly when the snowplow blade encounters an obstacle during the operation thereof, said arcuate arms and said ground-engaging bar forming a support holding said snow deflecting body at a predetermined height above the ground; and a thick flexible deflector made of rubber or the like material attached along the lower front edge of said snow deflecting body, said flexible deflector having approximately the length of said snow deflecting body and extending downwardly to the ground in front of the ground-engaging bar, the bottom edge of said flexible deflector resting against said substantially vertical flange which supports same and prevents said bottom edge from riding over said ground-engaging bar during the operation of said snowplow blade.

11. An implement attachment for supporting an implement to a small all terrain vehicle such as a three wheel or a four wheel motorcycle or the like, said vehicle having a chassis with the rear end thereof adapted to sustain pulling loads such as in drawing a trailer or similar equipment, said chassis including at the front end region thereof a cross-member, said implement being adapted to be positioned in front of said vehicle, said attachment comprising:

an elongated frame having a longitudinal axis and being adapted to be mounted under the chassis of said vehicle and extending longitudinally therealong, said frame being attached to said chassis at the rear end thereof whereby during the operation of said implement the stresses imposed to the vehicle and transmitted at the rear portion thereof, through said frame, in a form of a pulling load, said frame being suspended from said cross-member and comprising:

(a) implement carrying arm means pivoted at one end to the front portion of said frame for swinging relatively to said frame in a vertical longitudinal plane, for raising or lowering said implement relative to said frame and said vehicle, said implement carrying arm means comprising at the other end attachment means for holding said implement;

(b) actuation means cooperating with said implement carrying arm means for raising or lowering said implement carrying arm means; and (c) releasable connecting means attached to said frame, and cooperating with said cross-member for suspending said frame from said cross-member.

12. An implement attachment as defined in claim 11, wherein said implement carrying arm means is constituted by a plate having an end pivoted to said struts and an opposite end comprising said attachment means for holding said implement.

13. An implement attachment as defined in claim 11, wherein said frame is attached to the rear end of said vehicle by a ball and socket hitch.

14. An implement attachment as defined in claim 11, to be used with a three-wheel motorcycle said frame comprises a loop portion adapted to encircle the front wheel of said three-wheeled motorcycle.

15. An implement attachment as defined in claim 11, wherein said actuation means comprise a handle pivoted to said frame, connecting rod means connecting said handle to said implement carrying arm means whereby, by actuation of said handle, said implement may be raised or lowered.

16. An implement attachment as defined in claim 11, wherein said frame is constituted by two parallel struts having an upwardly projecting front end adapted to extend in front of said vehicle and a cross-plate interconnecting said struts in the front end region of said frame, the front end of said struts being adjacent said cross-member and carrying a retractable pin which overlies said cross-member, said frame being free to achieve within limits slight vertical and lateral movements relative to said vehicle and a slight rotational movement relative to said vehicle about the longitudinal axis of said frame which further includes guide means cooperating with said chassis to limit the vertical, lateral and the rotational movements of said frame relative to said vehicle.

17. An implement attachment as defined in claim 16, wherein the chassis of said vehicle includes a pair of roll bars extending longitudinally along said vehicle and having each an end attached to said cross-member, said roll bars being spaced from each other, the front end of said struts being inserted between said roll bars and including a pair of lateral projections extending below said roll bars and being vertically spaced therefrom, said projections being adapted to contact said roll bars to act as stops to limit the vertical and the rotational movements of said frame.

18. A snow removing unit to be mounted to a light all terrain vehicle such as a three-wheel or four-wheel motorcycle or the like, said vehicle being of the type having a rear end adapted to sustain pulling loads such as in drawing a trailer or similar equipment; said snow removing unit comprising:

(a) a shock-absorbing blade adapted to be mounted in front of said vehicle, comprising:

a transversely extending rigid snow deflecting body positioned generally vertically and having an upper edge projecting forwardly, said deflecting body being adapted to receive and deflect the snow in a generally frontal direction;

a ground-engaging bar extending parallel to and located below said snow deflecting body leaving an open space therebetween, said ground-engaging bar having approximately the length of said snow deflecting body and having a substantially vertical flat frontal surface;

rearwardly swinging arm means having an end pivoted to said body in a region thereof which is remote from the lower front edge thereof, said rearwardly swing arm means having an opposite end attached to said ground-engaging bar, said rearwardly swinging arm means being biased forwardly against stop means by return spring means to cause said ground-engaging bar to yield rearwardly when the snowplow blade encounters an obstacle during the operation thereof, said rearwardly swinging arm means and said ground-engaging bar forming a support holding said snow deflecting body a predetermined height above the ground;

a flexible deflector in the form of a thick strip of rubber or the like material attached to said snow deflecting body along the lower front edge thereof, said flexible deflector having approximately the length of said snow deflecting body and extending downwardly to the ground in front of the ground-engaging bar, the bottom edge of said flexible deflector resting against and being urged forwardly by said flat frontal surface during the operation of said snowplow blade;

(b) a frame for attaching said shock-absorbing blade to said vehicle, said frame being adapted to be mounted under the chassis of said vehicle and extending longitudinally therealong, said frame being attached to said vehicle at the rear end thereof and at an additional location thereof in front of said rear end, the attachment being made by releasable connecting means, whereby during the operation of said implement, the stresses imposed to the vehicle being transmitted at the rear portion thereof, through said frame, in a form of pulling load, said frame comprising:

implement carrying arm means pivoted at one end to the front portion of said frame in order to swing in a vertical longitudinal plane, for raising or lowering said implement, said implement carrying arm means comprising at the other end attachment means for holding said implement;

actuation means for raising or lowering said implement carrying arm means.

* * * * *